United States Patent [19]

Shank

[11] 4,258,706

[45] Mar. 31, 1981

[54] MUSCLE-RELAXING RECLINING CHAIR

[76] Inventor: Donald C. Shank, 1080 Rock Springs Rd., San Marcos, Calif. 92069

[21] Appl. No.: 961,552

[22] Filed: Nov. 17, 1978

[51] Int. Cl.[3] ..... A61H 1/00

[52] U.S. Cl. ..... 128/33; 128/24.1; 297/180

[58] Field of Search ..... 128/32-36, 128/24 R, 24.1; 5/365, 366, 421, 455; 297/180, 284, DIG. 3, DIG. 8

[56] References Cited

U.S. PATENT DOCUMENTS

| | | | |
|---|---|---|---|
| 2,245,909 | 6/1941 | Enfiajian | 128/24.2 |
| 2,437,006 | 3/1948 | Simpson | 128/33 |
| 2,684,672 | 7/1954 | Summerville | 297/180 |
| 2,967,524 | 1/1961 | Christensen | 128/24 R |
| 3,303,518 | 2/1967 | Ingram | 5/349 |

*Primary Examiner*—John D. Yasko
*Attorney, Agent, or Firm*—Leo R. Carroll

[57] ABSTRACT

A muscle-relaxing therapeutic reclining chair including a framework and an inclined body-receiving cushioned portion comprising a plurality of chamber-defining portions carrying liquid under controllable pressure therein and which in one preferred form can be heated in a controlled manner and with the entire device being capable of being selectively and controllably oscillated by a vibrator means whereby to not only provide a soft fluid support equivalent to that provided by a water bed, but to provide the application of a desired amount of relaxing heat to a user's body while at the same time applying a desired amount of vibratory movement to the user's body whereby to be conducive toward complete muscle relaxation with all of the inherent therapeutic effects alleged to flow therefrom.

2 Claims, 12 Drawing Figures

MUSCLE-RELAXING RECLINING CHAIR

BACKGROUND OF THE INVENTION

The field of the invention is generally that of chairs and, more particularly, the field of reclining chairs of the type sometimes referred to as contoured chairs, or the like, which are curved and upwardly and rearwardly generally inclined so that a person lies back on one in a semi-reclining or a near-reclining position for the purpose of achieving the maximum degree of relaxation without actually going to bed. Such reclining chairs are considered to be advantageous because almost all stress and strain is removed from the voluntary muscle system of the human body because of the full and complete semi-reclining support provided by such a chair, plus the fact that it places the body in a condition minimizing circulatory overload. In fact, in some cases, such contoured chairs have been referred to as heart chairs, meaning that a minimal load is placed on the heart when one is resting in such a reclining chair. This type of chair is in some cases superior to bed rest particularly for persons afflicted with respiratory problems of one sort or another such as emphysema, or even congestive heart disease, asthma or the like—in fact any situation where fluid may tend to accumulate in the lungs and such a slightly elevated position above the flat horizontal level of a true reclining supine position minimizes breathing difficulties. However, it is clear that if, in addition to the above advantages, such a reclining chair could facilitate or tend to increase blood circulation while maintaining a very relaxed condition of the muscles, such as is provided when one is passively massaged by another, this would be an advantageous type of construction. This is precisely what is provided by and in the novel muscle-relaxing therapeutic reclining chair of the present invention, and it has advantages completely overcoming various prior art disadvantages and limitations of conventional chairs, and all of which advantages flow from and occur by reason of the specific features of the invention pointed out hereinafter.

SUMMARY OF THE INVENTION

Generically speaking, the novel muscle-relaxing reclining chair of the present invention comprises a body-contoured, body-receiving, compressible effective cushion means provided with and carried by a reclining chair framework means of substantially rigid construction. The body-receiving, compressible, effective cushion means takes the form of a plurality of compressible, hollow, sealed chamber-defining portions which are arranged in substantially end-to-end contiguous relationship to each other in a length direction whereby to effectively define what might be termed a longitudinal, composite, body-receiving compressible pad means of a width slightly greater than that of a human body adapted to be received thereby and of a length slightly longer than that of a human body adapted to be received thereby. Indeed, in one preferred form, the plurality of sealed, hollow, chamber-defining portions may be said to have an effective head end and an effective foot end and effective intermediate torso and buttock portions, with the head end being supported by the reclining chair framework means at an elevation which is usually greater than the foot portion and with the buttock portion being supported by the framework means usually somewhat above the level of the foot portion and below the level of the head portion and with the torso portion being angularly oriented between the buttock portion and the head portion, whereby the entire longitudinal composed portion, body-receiving compressible pad means may be said to define a compound curvilinear surface, as seen in side elevation, such as to most readily conform to the corresponding contour of a person's body when in a modified partially erect but otherwise supine rest posture thereof.

Each of the compressible, hollow, sealed, chamber-defining portions defines a hollow fluid-receiving inner chamber effectively provided with fluid supply duct means adapted to be connected with a source of fluid under pressure (under a controlled and usually controllable adjustable pressure, although not specifically so limited in all forms of the invention) for supplying each such inner chamber with a quantity of pressurized fluid and for maintaining same at a desired (sometimes a predetermined, sometimes a pre-selected, and other times a controllably selectable at-the-moment-of-use pressure) for maximized corresponding human-body-portion-supporting efficiency and also for maximized comfort.

In one preferred form of the invention, the above-mentioned source of fluid under pressure comprises fluid pump means and pump-driving motor means (usually electric motor means, although not specifically so limited in all forms of the invention) with the motor means being in torque-applying relationship with respect to the corresponding fluid pump means which has a high-pressure output side connected to the previously mentioned supply duct means for supplying said fluid to said inner chambers at a controlled pressure.

In one preferred form the fluid pump means is effectively controlled by pressure-sensing inlet effective switch means in pressure-responsive relationship with respect to the pressurized fluid extending from the output side of the pump means to each such inner chamber and responding to the reaching of a selected maximum pressure thereof to effectively cause the deactivationof said pump means (usually by means of the deenergization of the corresponding pump-driving motor means, although not specifically so limited in all forms of the invention) whereby to prevent pressure within each inner chamber from exceeding a desired maximum value. In one preferred form of the invention said pressure-sensing effective inlet switch means is provided with manually operable inlet pressure selector means cooperable therewith for manually selecting a desired magnitude of pressure at which said effective switch means will be effectively activated in response thereto for causing corresponding effective deactivation of the pump means (usually by correspondingly deenergizing the pump-driving motor means, although not specifically so limited in all forms of the invention).

In one preferred form of the invention, each inner chamber is provided with exhaust duct means provided with and effectively connected to a fluid reservoir means by way of a normally closed but pressure-openable pressure bypass outlet valve means provided effectively in said exhaust duct means between each inner chamber and a hollow interior defined within said reservoir means. In one preferred version of the immediately above-mentioned form of the invention, the pressure bypass valve means is initially set in closed, non-bypassing relationship at pressures below a selected pressure whereby to be adapted to be opened only in response to the exceeding of that pressure by the pressurized fluid in the exhaust duct means and/or in the corresponding inner chambers, and preferably said pressure bypass valve is provided with manually operable pressure bypass outlet pressure magnitude selector means for selecting any desired pressure bypass magnitude corresponding to the manual selecting operation thereof. This usually will be very similar to the manually selected inlet pressure if not substantially identical thereto.

In one preferred form of the invention, electrically energizable heating means may be included in heat transfer relationship with respect to the fluid adapted to be supplied to and contained within each of the inner chambers for controllably electrically heating same to a particular desired muscle-relaxing temperature which may be said to effectively maximize the therapeutic effect thereof.

Of course, in the electrically operated forms of the invention, electric power-supplying circuit means is provided and is effectively coupled to the pump-driving motor means for controllably electrically energizing same and is also coupled to the electrically energizable heating means for controllably energizing same. The electric power-supplying circuit means may be connected to a suitable source of electric power, either self-contained or comprising a conventional auxiliary source of electric power such as that usually provided in homes, buildings and the like, in which case an electrical connector means may be provided for connecting said power-supply circuit means to such an auxiliary outside conventional source of electric power, such as by way of a conventional wall plus or the like.

One preferred form of the invention may also include temperature selector means cooperable with the power-supplying circuit means and the heating means for controllably selecting a desired maximum temperature of the fluid heated thereby and operable when said temperature has been reached to effectively deenergize the heating means until the temperature of the fluid falls to a second lower magnitude at which time the selector means is operable to effectively reenergize the heating means.

In a preferred form of the invention, inlet manifold and outlet manifold means may be employed in both the supply duct means and the exhaust duct means respectively for the purpose of effectively equalizing the corresponding pressures relative to the various inner chambers connected thereto.

One preferred form of the invention is also provided with effective vibrator means for individually imparting vibratory movement to various parts of the composite longitudinal mounting pad means formed by the plurality of individual compressible, closed, sealed chamber-defining portions. Each vibrator means, in a preferred form, may comprise vibrator motor means (usually controllably electrically energized vibrator motor means, although not specifically so limited in all forms of the invention) and vibration-causing output means coupled thereto or effectively carried thereby. In a preferred version, the vibration-causing output means takes the form of a rotatingly driven vibrator motor means output shaft and a corresponding rotor, in the form of an eccentric mass attached thereto and rotated thereby, whereby to effectively impart a rotating inertial force to the vibrator motor means, the output shaft and the eccentric rotor and mass and to a corresponding separate part of said mounting pad means or portion carrying said hollow sealed chamber-defining portion.

In a preferred form, each vibrator motor means is provided with a motor-mounting plate and resilient mounting means therefor connecting same relative to a fixed portion of the framework means whereby to provide for resilient oscillatory movement of the vibrator motor means relative to the framework means. The vibrator motor means and the rotor are effectively provided with coupling abutment means, in one preferred form positioned in abutment with (usually in abutment with an underneath surface portion of) the hollow, compressible, sealed chamber-defining portion lying immediately thereover. In one preferred form, this may be accomplished through an intermediary coupling provided by a corresponding underlying resilient pad means portion whereby to impart vertical rotary vibratory movement thereto in response to power-rotation of said vibratory motor means and said eccentric mass.

In one preferred form of the invention, the reclining chair framework means is provided with concealing side and rear walls whereby to effectively define a mechanism-containing and mechanism-concealing enclosure means in the lower portion of the reclining chair framework means which is adapted to contain substantially all of the mechanism associated with the muscle-relaxing reclining chair, and which is preferably provided with a controllably openable and closeable access door means for convenient entry thereinto for mechanism repair and/or replacement purposes when such is needed.

In one preferred form of the invention, the inlet and outlet pressure with respect to the plurality of inner chambers of the effective cushion means are provided with manually controllably adjustable selector means for selecting desired pressure magnitudes thereof, and such are preferably mounted at a conveniently accessible location on some exterior portion of the reclining chair framework means, such as on one or the other of a pair of laterally spaced armrest portions thereof and, in one preferred form, may be mounted in a recessed manner provided with a controllably openable and closeable cover means for the selector controls or for a complete panel of same. It should also be noted that the same provision applied to the temperature selector means and/or to the vibrator means which may be provided with vibration amplitude controlling and selector means, all of which may be button or switch operated and all of which may be carried by one or more such control panels adapted to be mounted on one or more of the armrest portions of the reclining chair framework, and preferably with such recesses being provided with such cover means, thus making it possible to control the supporting pressure of the underlying cushions, the effective surface temperature thereof, and the presence or non-presence of vibratory movement, and the extent or magnitude thereof, and to do so entirely by way of such chair-arm-mounted multiple push button type of control panels which will make it possible to do the controlling while lying in a fully relaxed manner on the multiple-cushion surface of the reclining chair.

OBJECTS OF THE INVENTION

With the above points in mind, it is an object of the present invention to provide a novel muscle-relaxing reclining chair which is capable of providing essentially fluid support of a controllably adjustable pressurized type and which is capable of providing complete temperature control of the supporting fluid, if desired, and which is further capable of applying a desired extent and magnitude of vibration to the body of a person reclining on the chair for any desired period of time—all for the purpose of prducing the maximum degree of relaxation and all being either independently provided, or not provided, as desired, and independently or conjointly useable, or not useable, as desired, for the purposes outlined above.

It is further object of the present invention to provide a novel muscle-relaxing reclining chair of the character referred to herein generically and/or specifically, which may include any or all of the features referred to herein either individually or in combination, which is capable of being manufactured in a relatively simple manner having a minimum of functions, capable of being manufactured in a somewhat more complex manner provided with or having more functions or alternate functions, and capable of being manufactured in a substantially more complex manner involving and including even more functions, or a combination of all of same as described in greater detail elsewhere herein, and which in its simplest form can be manufactured at a relatively low cost, both as to the initial production set-up cost and as to the subsequent per-unit cost, such as to be conductive to widespread use of the apparatus for the purposes outlined herein or for any other substantially equivalent purposes.

Further objects are implicit in the detailed description which follows hereinafter (which is to be considered as exemplary of, but not specifically limiting, the present invention), and said objects will be apparent to persons skilled in the art after a careful study of the detailed description which follows.

For the purpose of clarifying the nature of the present invention, several exemplary embodiments of the invention are illustrated in the hereinbelow-described figures of the accompanying four sheets of drawings and are described in detail hereinafter.

BRIEF DESCRIPTION OF THE DRAWINGS

As illustrated in FIG. 7 the first, lowermost or foot section of the composite cushion means is shown as representative of all four of the hollow cushions. However, for drawing convenience purposes, it has been erected into a horizontal orientation in FIG. 7 from its actual downwardly inclined true orientation as is best shown in FIGS. 1 and 2.

DESCRIPTION OF THE PREFERRED EMBODIMENTS

Figure 1:
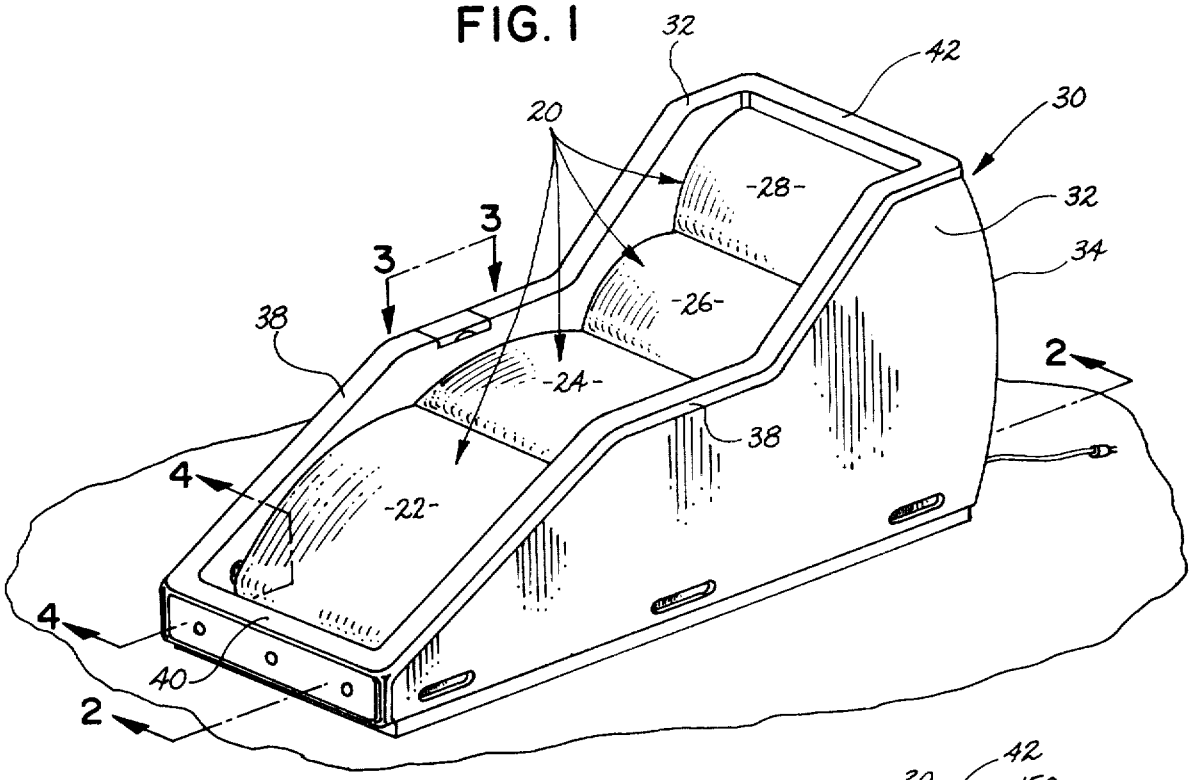
FIG. 1 is a greatly reduced-size, three dimensional, pictorial, isometric drawing illustrating one exemplary embodiment of the invention in fully assembled operative condition ready for use.

The exemplary first form of muscle-relaxing reclining chair of the present invention, as illustrated in FIGS. 1–8 inclusive in a typical representative but non-specifically limiting fashion, includes a body-contoured, body-receiving, compressible effective cushion means provided with and carried by a reclining chair framework means of substantially rigid construction. As is perhaps best shown in FIG. 1, the just mentioned body-contoured, body-receiving, compressible effective cushion means is generally designated at 20 and comprises a plurality of compressible, hollow, sealed chamber-defining portions, such as indicated at 22, 24, 26 and 28 in the example illustrated, which are arranged in substantially end-to-end edge-contiguous relationship to each other whereby to effectively define a longitudinal composite body-receiving compressible pad means of a width slightly greater than that of a human body adapted to be received thereon and also of a length slightly greater than that of a human body adapted to be received thereon. In the example illustrated, because said compressible pad means is essentially the same structure as the previously mentioned plurality of body-contoured, body-receiving compressible effective cushion means, said pad means is also designated generally by the reference numeral 20.

In the example illustrated, the above-mentioned reclining chair framework means is generally designated by the reference numeral 30, and comprises a pair of similar side wall means 32, a rear wall means 34 which, in the example illustrated, comprises a controllably openable and closeable rear-positioned access door means for entry into the interior mechanism-containing and mechanism-concealing enclosure means, indicated generally at 36, defined within the lower rear inside region of the reclining chair framework means 30. Said reclining chair framework means 30 also includes, in a manner extending along and effectively supported by the side wall means 32, a pair of laterally spaced armrest portions 38 and a transversely directed foot member 40 at the lower front or bottom of the entire framework means 30 and a similarly transversely directed structural head member 42 at the rear, upper or top of the entire framework means 30, with said foot member 40 and head member 42 functioning as structural members inter-connecting the armrest portions 38 and the two side walls 32 in a structurally strong manner. The framework means 30 also includes bottom-positioned structural members 44 and a bottom floor member 46 carried thereby thus, together with the rest of the above-mentioned portions of the framework means 30, defining a rigid structurally strong framework means 30 defining a longitudinal substantially rectangular opening therewithin adapted to receive the plurality of effective cushion means, comprising the longitudinal composite body-receiving compressible pad means 20, therewithin and somewhat below the level of the upper side wall means 32 and, correspondingly, somewhat below the level of the side-positioned armrest portions 38 so as to define a convenient-to-use reclining chair.

The framework means 30 also includes an inner supporting or mounting panel portion, in four sections, each of which is indicated by the reference numeral 48, which are firmly supported by being attached to the front structural foot member 40 at the lower or front end thereof and to the upper or rear structural head member 42 at the other end thereof and by being attached at each side of each of the four supporting or mounting portions 48 to corresponding parts of the two side wall means 32. It should be noted that each of the four supporting or mounting portions 48 lies within the two side wall means 32 and, as seen in side elevation in FIG. 2, defines a compound curvilinear upper supporting surface well suited to the resting contour or shape of the human body and, thus, suitable for supporting the four previously mentioned compressible, holow, sealed chamber-defining portions 22, 24, 26 and 28 thereabove, as can be seen in both FIG. 1 and FIG. 2, in a manner such that it can be said that the hollow chamber-defining portion 22 might be said to be an effective foot end or portion of the composite compressible pad means 20, while the next upwardly adjacent compressible hollow sealed chamber-defining portion 24 may be said to comprise an intermediate torso portion of the composite pad means 20. The next upwardly adjacent chamber-defining portion 26 may be said to effectively comprise an intermediate torso portion of the composite compressible pad means 20, and the next upwardly adjacent or top-positioned chamber-defining portion 28 to comprise an effective head end or portion of the composite compressible pad means 20. It should be noted that, in the exemplary first form of the invention illustrated, the composite compressible pad means 20, made up of the four exemplary but non-specifically limiting hollow chamber-defining portions which might also be called hollow pillows or cells, is supported above the mounting or supporting panel means 48 by way of an interposed resilient pad means portion or sheet 50 which preferably may be made of cellular plastic foam material, such as polyurethane foam material or the like, although not specifically so limited, or may be made of foam rubber or the like, whereby to provide a soft resilient pressure-equalizing sheet or layer immediately under each of the hollow cells or pillows 22, 24, 26 and 28. However, it should be noted that the invention is not specifically so limited in all forms thereof and the interposed sheet of plastic or rubber, or other elastomeric foam material, 50, may be modified substantially or, in certain forms of the invention, may be eliminated entirely.

Figure 7:
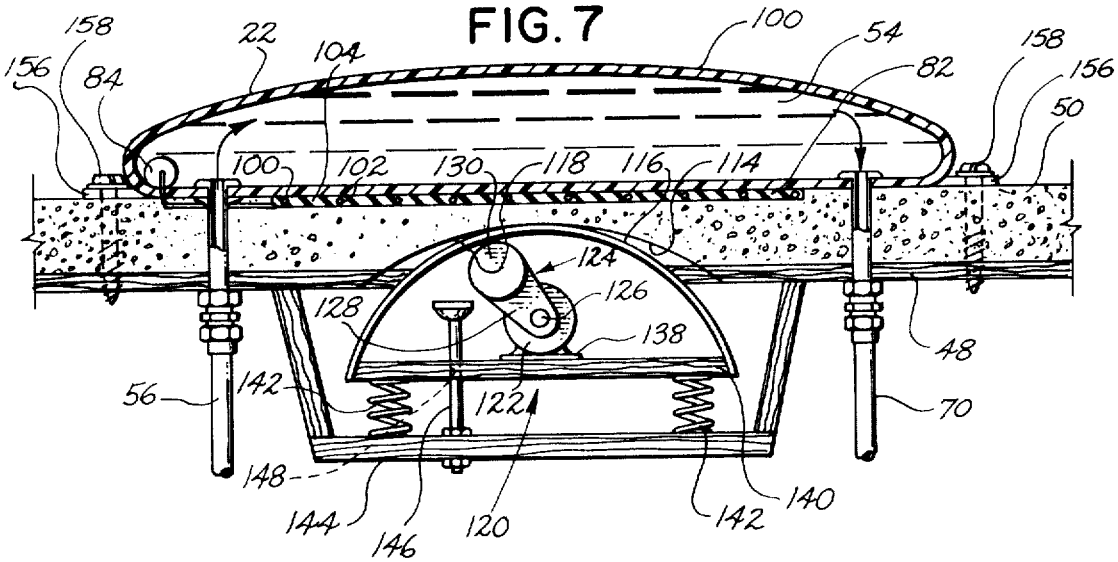
FIG. 7 is an enlarged view taken substantially on a vertical central plane of the complete apparatus and is generally similar to any representative one of the sections of the complete assembly, or plurality, of individual, compressible, hollow, sealed chamber-defining portions or cushions of the four representative ones illustrated in FIGS. 1 and 2 as comprising the complete assembly thereof and is for the purpose of illustrating, in a representative way, all of same with respect to the fluid pressurizing and maintaining system, the temperature maintaining system, and the vibrating apparatus for selectively controllably imparting a desired magnitude of vibratory movement to the entire section in contact with a corresponding portion of a body of a person when such a person is reclining on the body-receiving, compressible, longitudinal pad means of the reclining chair.

Each of the chamber-defining portions effectively comprising the four representative hollow pillows or cells defines a hollow fluid-receiving inner chamber and, since all four of same are similar, each will be designated by the same reference numeral 52 thus making the description of the operation of a representative one thereof, such as illustrated in FIG. 7, applicable to all.

Each of the inner chambers 52 is adapted to receive a fluid (usually a liquid) therein, such as is indicated diagrammatically in 54 in FIG. 7 representative of all four of said inner chambers 52. Wile the fluid 54 may comprise any type of suitable working fluid or medium, it preferably will comprise some conventional hydraulic liquid type of fluid which is conventionally commercially available and for which pump means are also available.

As illustrated, each of the inner chambers 52 is provided with fluid supply duct means, each of which is indicated by the reference numeral 56, adapted to be connected to a source of fluid under pressure for supplying each such inner chamber 52 with a quantity of the pressurized fluid 54 and for maintaining same at a desired pressure for maximized corresponding human-body-portion-supporting efficiency and comfort.

Figure 6:
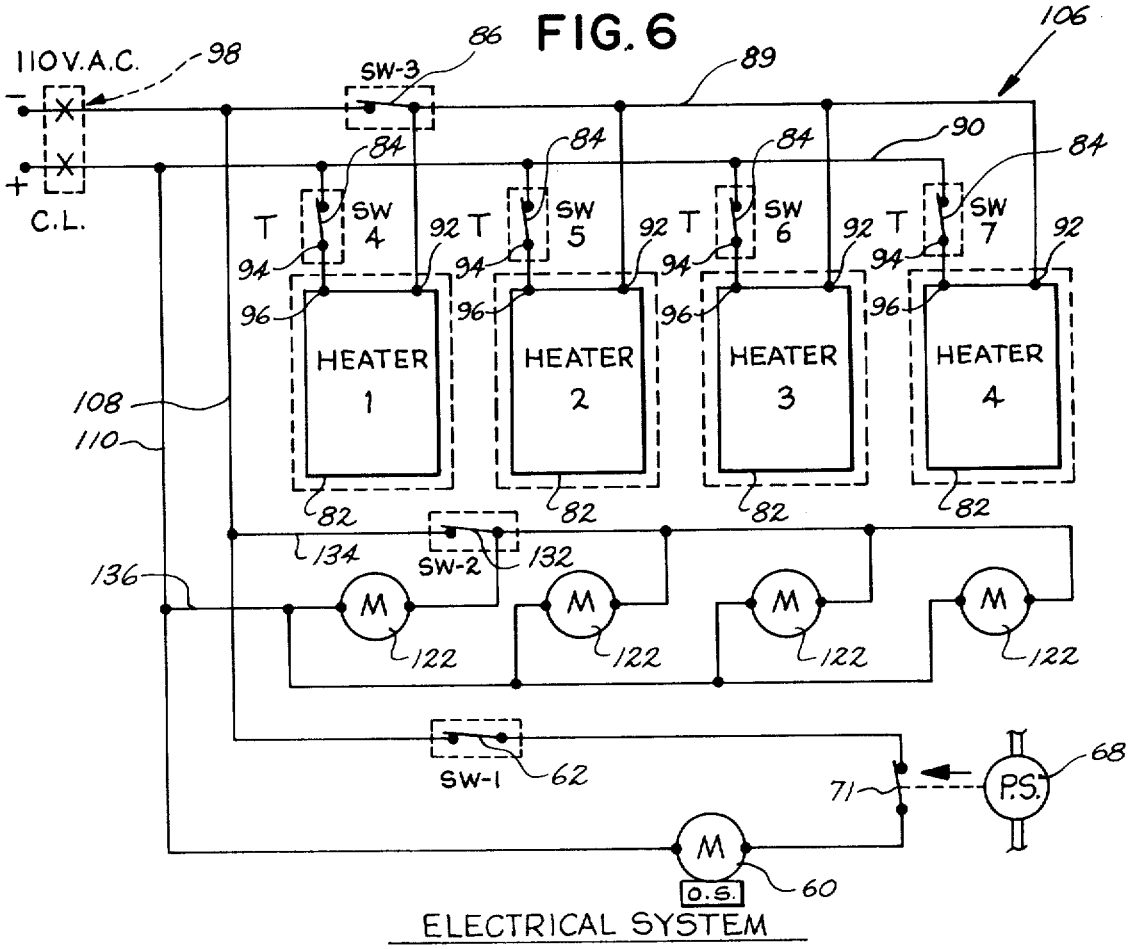
FIG. 6 is an electrical schematic view generally illustrative of one representative form of electrical system or electric circuit means for not only operating the fluid pressure maintaining system of FIG. 5, but for, also, operating a heating system for maintaining the fluid in the hollow cushions within a desired temperature range when the heating option is selected, and for operating vibrator apparatus.

In the example illustrated, the above-mentioned source of fluid under pressure effectively comprises a fluid pump means, indicated at 58, which is driven by pump-driving motor means such as that shown at 60 in the electrical schematic view comprising FIG. 6. The arrangement is such that the motor, when energized by the closure of the normally opened main switch 62, drives the pump 58 so that the high pressure output side 64 of the pump 58 will feed the pressurized fluid 54 through a check valve 65 into a pressure-equalizing inlet manifold means 66 and then through the four separate supply duct means 56 into the hollow interior 52 of each of the four hollow pillows or cells 22, 24, 26 and 28. This will, of course, effectively inflate each of the hollow cells or pillows until such time as the pressure reached therein, and correspondingly reached in the interior of the inlet manifold means 66, reaches a predetermined magnitude which will be sensed by a pressure-sensing inlet means (usually a pressure-sensing inlet electrical switch means) such as is indicated at 68 and which will correspondingly open a normally closed electrical switch such as that shown at 70 in the electrical schematic view comprising FIG. 6 which will, of course, then deenergize the pump-driving motor means 60 and stop any further pressurization of any of the four inner chambers 52 of the four hollow pillows 22, 24, 26 and 28 at the particular desired interior pressure magnitude thereof which will normally be a pressure selected because it is ideal for providing both comfort and adequate support to a semireclining human body resting on the four hollow pillows in a slightly erected supine position.

It will be understood that whenever the pressure sensed by the pressure-sensing inlet switch means 68 falls below the operating predetermeined magnitude mentioned above, the electrical switch 70 controlled thereby (best shown in FIG. 6) will return to its normally biased closed position which will again reactivate the pump-driving motor 60 to restart the pressurization operation all over again provided that the main pressurizing switch 62 is still in the closed or energizing position thereof. Thus, it can be seen that the pressurizing arrangement just described will continue to cycle on and off as needed as long as the electrical pressurizing circuit is energized by closure of the main on and off pressurization manual control selector switch 62 is in the activated position. Whenever said switch 62 is manually moved to the off position, of course, no further operation of the pressurization system will occur thereafter. Normally this will not means that the four pressurized hollow pillows 22, 24, 26 and 28 will immediately collapse—quite the contrary, inasmuch as the check valve 65 in the high pressure output lead 64 from the pump 58 prevents any return flow of the pressurized fluid from the four inner chambers 52 and thus maintains the four hollow pillows 22, 24, 26 and 28 in pressurized condition as modified by any small amount of leakage which may occur—usually over a substantial period of time. It will be found in the subsequent description of the four exhaust duct means 70 and the exhaust outlet manifold 72 communicating the four inner chambers 52 with the reservoir means 74, that they do not substantially modify the above pressure-holding capability of the system and of the four hollow pillows 22, 24, 26 and 28 when the pressurization system energization switch 62 is in the off position.

Each of the inner chambers 52 is also provided with the exhaust duct means 70 mentioned above which is effectively connected to the above-mentioned fluid reservoir means 74 by way of a normally closed, pressure-openable, pressure-bypass outlet valve means 76 which may be merely a pressure relief valve connected between the outlet manifold means 72 (to which all of the exhaust duct means 70 are connected) and an inlet opening 78 into the hollow interior 80 within the reservoir means 74. Thus, the arrangement is such that none of the pressurized fluid 54 can be fed through the return duct means 70 into the hollow interior 80 of the reservoir means 74 unless the pressure in said inner chambers 52, exhaust duct means 70 and/or within the outlet manifold means 72 exceeds a predetermined pressure magnitude at which the pressure-bypass outlet means 76 is set. Usually this pressure magnitude will be slightly higher than the pressure magnitude of the setting of the previously mentioned pressure-sensing inlet switch means 68, thus providing an arrangement where each of the inner chambers 52 will be pressurized until a first predetermined pressure is reduced at which time the pressure-sensing inlet switch means 68 will cause the deactivation of the entire pressurization system in the manner previously described but it will be noted that the pressure within each of the inner chambers 52 will still be less than that required for return flow through the pressure-bypass outlet valve means 76. This will prevent any loss of fluid pressure from within the inner chambers 52 of the four hollow pillows 22, 24, 26 and 28 except under unusual conditions such as that which would encountered if a perison bounces or steps or otherwise physically applied excessive exterior pressure to any one of the hollow pillows, which might cause the interior pressure within the corresponding inner chambers 52 to temporarily tend to raise to excessively high values which might normally rupture same. Such a rupture will be prevented because under such peculiar circumstances any temporary increase in interior pressure within any of the inner chambers 52 will cause the opening of the pressure-bypass outlet valve means 76 and allow a certain quantity of the fluid 54 to be exhausted therethrough into the reservoir means 74. This is entirely a protective action and will operate to protect the four hollow pillows under all such unusual circumstances of use. It should also be noted that in the event that for some reason the pressurizing system comprising the pump-driving motor 60 and the pump means 58 operates excessively or in some manner tends to overfill the inner chambers 52—perhaps because of a temporary inactivation, deactivation or malfunction of the pressure-sensing inlet means 68—the above-mentioned exhaust system and, in particular, the exhaust pressure-bypass outlet valve 76 will act in the same protective manner as that just described above and will cause any excess pressure (well below the safety limit of the hollow pillows) to be returned or exhausted through said pressure-relief outlet valve 76 into the reservoir means 74.

In one preferred form of the novel muscle-relaxing reclining chair of the present invention, heating means is provided in heat transfer relationship with respect to the pressurized fluid 54 adapted to be supplied to and contained within each of the inner chambers 52 in each of the hollow pillows 22, 24, 26 and 28 and may be arranged to be controllably energized (usually controllably electrically energized, although not specifically so limited in all forms of the invention) for heating said fluid or liquid 54 to a desired muscle-relaxing and even possibly therapeutic temperature. In the exemplary first form of the invention illustrated in FIGS. 1–8, inclusive, there are four such heating means or heating panels, such as the exemplary one physically shown at 82 in FIG. 7 positioned at the bottom of the hollow chamber 52 of the hollow pillow 22 in effective heat-transfer relationship with respect to the liquid or fluid 54 contained therein so that when electrical power is fed to each such heating panel 82 (there being four of same, as is best shown in FIG. 6), each heating panel 82 will correspondingly heat the liquid or fluid 54 contained within the corresponding inner chamber 52 of the corresponding one of the four hollow pillows 22, 24, 26 and 28 and will continue to do so for as long as the corresponding one of the four thermostatic switches 84 remains in its normally closed position as best is shown in FIG. 6. This, of course, is all predicated upon the manual closure of the temperature selector means comprising the temperature selector switch 86 carried by the armrest-supported recessed control or selector panel means indicated at 88.

In the example illustrated, there are four such heater panels 82, as is best shown in FIG. 6, and each is adapted to be mounted below the corresponding inner chamber 52 in a manner substantially identical to the representative showing of FIG. 7 and each of same is adapted to be provided with and connected through a corresponding one of four different normally closed thermostaticswitches in a manner similar to the showing of the representative single thermostat switch shown at 84 in FIG. 7. The temperature selector means or switch 86 is adapted to be connected in one electric-power-supplying circuit means lead, indicated at 88, as is best shown in FIG. 6, while the other lead 90 of said electric-power-supplying circuit means is adapted to be connected to one terminal of each of the previously described thermostatic switch means 84. The first-mentioned power-supplying-circuit means lead 88 is adapted to be connected to one terminal of the corresponding heating panel means 82 as indicated at each of the four locations shown at 92 in FIG. 6, while the other terminal, such as indicated at 94 in FIG. 6 of each of the four thermostatic switch means 84, is adapted to be connected to the other corresponding terminal 96 of each of the four heating panel means 82 in the manner indicated in FIG. 6. The two leads 88 and 90 mentioned above are adapted to be provided with electrical connector means, indicated diagrammatically in broken lines at 98 in FIG. 6, adapted to be connected to any convenient conventional auxiliary source of electric power, such as the conventional wall plug 110 to 117 volt alternating current type of outlet conventionally available in many houses, building and the like, although not specifically so limited.

Each of the thermostatic switches 84 functions to deenergize the corresponding heating panel 82 whenever the temperature sensed by the thermostatic switch 84 (which is in direct heat transfer contact with the heated fluid or liquid 54) rises to a predetermined upper temperature magnitude. Thereafter, with each heater 82 in de-energized and deactivated condition, the temperature of the fluid or liquid 54 will tend to fall somewhat as a result primarily of radiation and conduction heat losses outwardly through the outer surface 100 of each of the hollow pillows. This heat loss will normally occur at a relatively slow rate. Thus, it may take a considerable period of time before the temperature of the liquid or fluid 54 in each inner chamber 52 falls to a second lower temperature magnitude such as to cause the reverse actuation of each of the thermostatic switches 84 from open condition to closed condition. Whenever this occurs, each of the corresponding heating panel means 82 will again be re-energized and the heating of the corresponding quantity of liquid or fluid 53 in the corresponding inner chamber 52 of each of the corresponding four hollow pillows will begin again and will continue until the above-mentioned cycle of heating and cooling action is repeated.

In the example illustrated, each of the thermostatic switches 84 is of any conventional type, such as a bimetallic strip, for example, wherein the differential coefficient of expansion of two dissimilar materials forming the bimetallic strip is such as to cause the physical actuating movement of the free tip end thereof at the two above-mentioned different actuation temperatures comprising the first-mentioned higher temperature magnitude where the tip end of each bimetallic thermostatic arm is actuated in a switch-opening direction and the above-mentioned second lower magnitude where the two materials of the bimetallic element cause the oppositely directed actuation of the free end of the thermostatic switch arm in a switch-closing manner. Of course, it should be understood that the invention is not limited to only a bimetallic type of thermostatic switch. That is merely representative of one of the many different temperature-responsive or temperature-sensing effective switch means which are capable of being employed for the temperature responsive switch actuating purposes just described.

It should be noted that the four representative heating panel means 82 are shown as comprising, in each case, a pad type of heating means which in effect comprises a low-temperature, large-surface-area heating means and may take the form of an alternating grid of electrically conductive input and output wires, as indicated in representative form at 100 and 102 respectively in FIG. 7 and in each case with the wires of each different grid connected to a different corresponding one, two heater terminals 92 and 96 being spaced apart by a body of matrix material 104 of which virtually the entire heating panel means 82 is made—said body of matrix material 104 preferably being a rubber-like or elastomeric type of material of relatively high electrical resistivity provided with a quantity of electrically conductive material (usually in particle form, although not specifically so limited in all forms of the invention) disseminated within the body of matrix material 104. The electrically conductive material may be disseminated in patterned arrangements, specifically with reference to the grid electrode members 100 and 102 spaced apart thereby, or may be of a relatively evenly disseminated character. In any case, the purpose of the disseminated conductive particles and the relatively non-conductive matrix material is to povide a path of controlled conductivity or controlled resistivity between the spaced grid members 100 and 102 whereby to provide for the controlled passage of a desired amount of electric current therethrough—that is, between the spaced wire members 100 and 102 by way of the intervening portions of the matrix 104 carrying said conductive material therein. The arrangement can be so designed so as to provide precisely the desired amount of heating output power per square inch of each heating panel 82 whereby to produce the desired amount of heating of the liquid or fluid 54 in each inner chamber 52 when each heating panel 82 is energized by closure of the manual temperature selector switch 86 and as long as each of the thermostatic switches 85 remains closed. The detailed construction of the above-mentioned type of large-surface-area, low-temperature heating panel means is not shown with great particularity since such arrangements are well known in the heating art. Only a sectional view in FIG.

Figure 2:
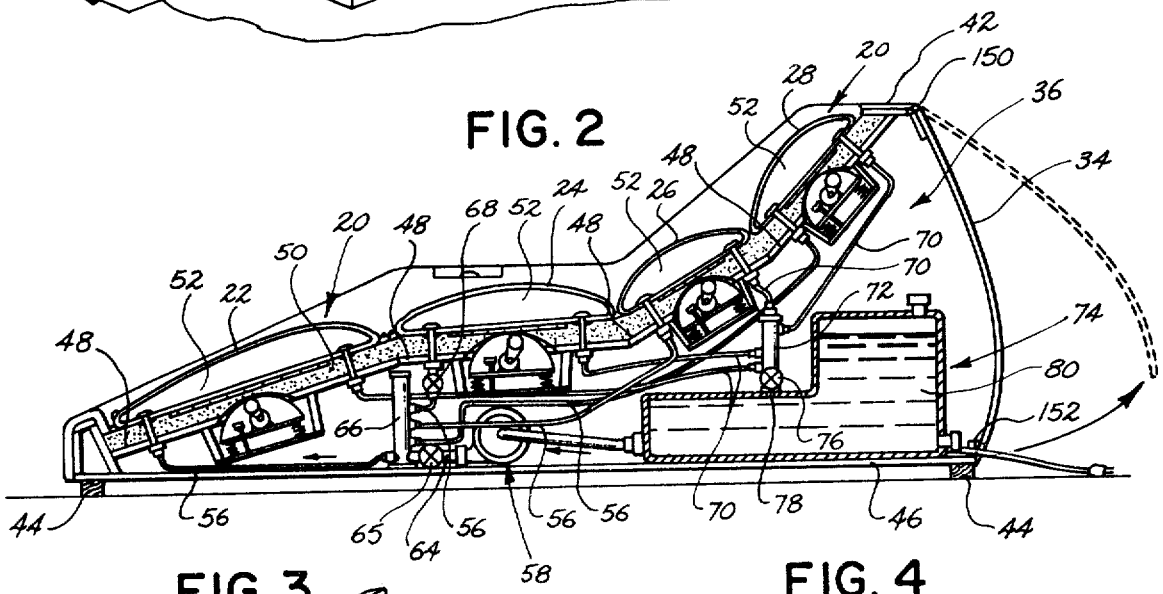
FIG. 2 is a view, partly in elevation and partly in vertical section, taken substantially along the plane and in the direction indicated by the arrows 2—2 of FIG. 1. This view also shows an exemplary rear-positioned access door means for use in gaining access to the interior concealed mechanisms when such may need repair or replacement.

7 (a view representative of each of the four similar arrangements of FIG. 1 and 2) to support the foregoing description thereof.

Furthermore, it should be noted that each of the heating means may be modified substantially from the exemplary form illustrated and described in some detail hereinabove, provided only that it supplies a desired amount of heat, under desired conditions and usually between desired maximum and minimum temperatures, to the liquid or fluid.

The two electrical leads 88 and 90 mentioned above comprise a portion of electric-power-supplying circuit means, generally designated by the reference numeral 106, which also includes another part as yet undescribed provided with two main power supply leads 108 and 110 which supply power to the previously-mentioned pump driving motor 60 whenever the main on-off pressurization selector switch means 62 is in closed relationship whereby to cause the operation of the corresponding pump means 58 as the inlet pressure sensing switch means 68 has not sensed the reaching of a first predetermined magnitude of pressure in the pressurized liquid or fluid and consequently caused the opening of the normally closed pressure-responsive switch 70. The same electric-power-supplying circuit means 106 will also be shown shortly hereinafter to comprise the means for supplying electric power to another optional portion of the apparatus of the present invention comprising vibrator means for individually and controllably imparting vibratory movement to any or all of the hollow pillows 22, 24, 26 and/or 28.

Each hollow, sealed, chamber-defining portion 22, 24, 26 and/or 28 is provided with an underlying mounting pad portion, in the example illustrated (although not specifically so limited in all forms of the invention) which is shown as comprising the previously-mentioned layer of polyurethane foam material or the like 50 which lies immediately under the bottom surface of each of the hollow pillows and immediately above and rests upon a corresponding underlying mounting panel portion 48 attached to and comprising a part of the framework means 30. However, each of the four underlying mounting panel portions 48 has a cut-out portion as indicated at 114 which receives a curved dome-shaped top surface 116 (which, in effect, comprises vibrating coupling abutment means) in abutment with the corresponding partially cut away underneath central surface portion 118 of the corresponding part of the mounting pad portion 50 for imparting vertical rotary vibratory movement therethrough in response to operation of the corresponding vibrator means, indicated generally at 120, which comprises an electrically energizable vibrator motor means 122 and vibration-causing output means carried thereby, indicated generally at 124 and, in the specific example illustrated, taking the form of a rotatingly driven vibrator motor means output shaft 126 and a corresponding rotor 128 provided with an eccentric mass 120 whereby to in effect comprise an eccentric rotor and mass adapted to be power-rotated by the vibrator motor means 122 whenever it is electrically energized by manual selection and closure of the vibrator selector switch means 132 which is part of the assembly of three different sets of control selectors or switches set forth in the recessed armrest-supported control or selector panel means indicated at 88 in FIG. 3 and in FIG. 8.

In the exemplary arrangement best shown in FIG. 6, it will be noted that power leads 134 and 136 are connected to the two previously-mentioned power leads 108 and 110 of the electric-power-supplying circuit means, indicated generally at 106, as is best shown in FIG. 6, whereby to provide power to one side of each of the four vibrator motor means 122, while the other side of each of same is connected through the selector switch means 132 to the other power lead. While this electric circuit arrangement is clearly shown schematically in FIG. 6, it should be also understood that each of the vibrator motors 122 is provided with a vibration-causing output means similar to that shown at 124 in FIG. 7, and that each of same rotates an eccentric mass similar to that shown at 130 in FIG. 7 and that, because the rotating assembly in each case is fastened as indicated at 138 in FIG. 7 to a vibrator mounting panel 140 which, in turn, is spring-mounted by spring means 142 to a rigid base member 144, the rotary eccentric inertial forces provided by the rotating eccentric mass 130 will cause the entire vibrator means 120 to vibrate vertically as one component of an actual would-be elliptical path of travel from which it is constrained by reason of the springs 142 and the positioning of the dome-shaped coupling member 166 within the cut-away 114 in the base mounting panel 48. As a result thereof, vertical oscillatory vibratory movement is applied by the dome-shaped coupling member 166 to the curved underneath surface 118 of the pad 50, and by way thereof, to the entire hollow pillow 22.

Constraint means is additionally provided for limiting the actual movement of the vibration output means 120 to a substantially vertical direction and, as illustrated, this comprises an upstanding guide rod or pin 146 fastened to the rigid lower support member 144 and slidably extending through an aperture located at 148 in the moveable vibrator motor base panel 140, thus limiting movement to substantially vertical oscillatory movement.

In the exemplary first form of the invention illustrated in FIGS. 1–8 inclusive, the framework means, indicated generally at 30, as previously mentioned, includes not only the two side wall means 32 topped by the two armrest means 38 and terminating at the forward bottom end and the rear top end in the transverse structural members comprise the foot member 40 and the head member 42, but as previously mentioned, also includes the front and rear bottom transverse structural members 44 which carry the bottom or floor panel 46, and with the rear of the framework means 30 being hingedly provided with the access or entry door means 34 which is shown as being hinged at the top by hinge means 150 and being adapted to be provided with a closure snap fastener, or the like, 152 at the bottom thereof. The arrangement is such that all of the previously described mechanism can be contained within the inner chair enclosure 36 defined between the side walls 32, above the floor panel 46, and forwardly of the entry or access door 34. Thus, all of the mechanism is normally completely concealed from view and furthermore the sound of operation thereof is substantially muffled by the surrounding and enclosing portion of the chair framework means 30. However, whenever repair of any mechanical part or replacement thereof is required, it is only necessary to open the rear entry or access door 34, and full and complete access to the interior mechanism can be conveniently had for such repair and/or replacement purposes. Incidentally, it should be noted that the particular type of entry or access door illustrated is exemplary only and is not intended to be construed as limiting the invention in any manner whatsoever. Actually, the door may be hinged at the bottom or at either side instead of at the top and in certain forms of the invention the access door may comprise a portion of one of the side walls if desired. Any means for providing convenient entry into the enclosure 36 for repair or replacement of any of the mechanical parts of the mechanism are intended to be included and comprehended within the broad scope of the present invention.

Figure 3:
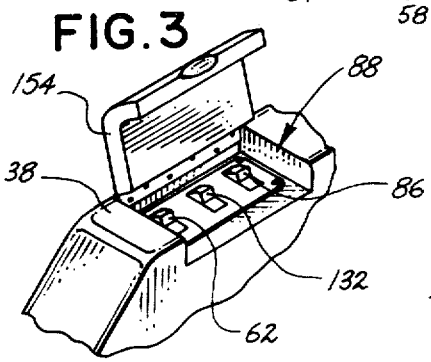
FIG. 3 is a somewhat enlarged, fragmentary, partially broken-away view illustrating one exemplary form of recessed chair-arm-mounted control panel means for three of the multiple manually controllably operable selector means.
Figure 8:
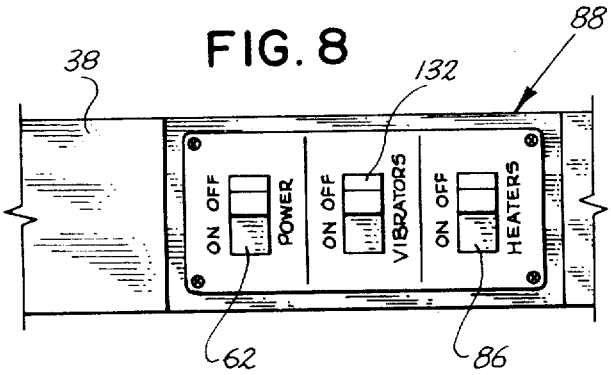
FIG. 8 is an enlarged top plan view of a representative form of control panel means for the various different apparatuses, in this case comprising the heating means, the vibrator means and power for the entire electric circuit means, in addition to the pressurization system.

It should be noted that, while the three selector or control members 62, 86 and 132 are shown as being carried by the single control panel 88 (as is best shown in FIGS. 3 and 8) and while said control panel 88 is illustrated as being recessed in the corresponding chair arm 38 and is shown as being provided with a hingedly mounted cover 154 which can normally be closed so as to completely cover and conceal the three control or selector members 62, 86 and 132, that is merely one convenient representative arrangement of the manually operable control or selector members. The invention is not specifically limited to that particular desirable arrangement. Actually, the controls may be located together or separately and at any desired location (or locations), concealed or not concealed, as desired.

Figure 4:
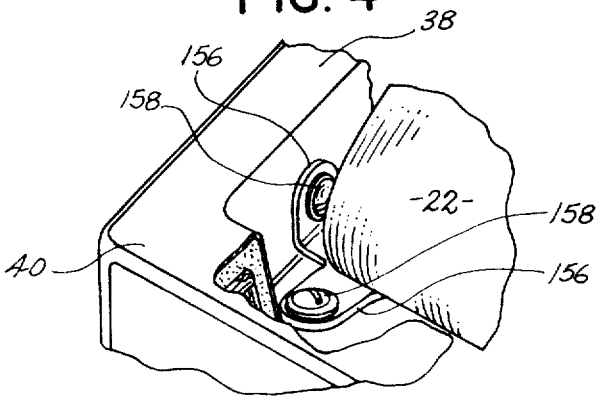
FIG. 4 is an enlarged, fragmentary, partially broken-away, isometric view illustrating two typical representative mounting structures for attaching the complete effective compressible pad means or cushion means with respect to the rigid reclining chair framework means in an appropriate and yet firmly attached manner.
Figure 5:
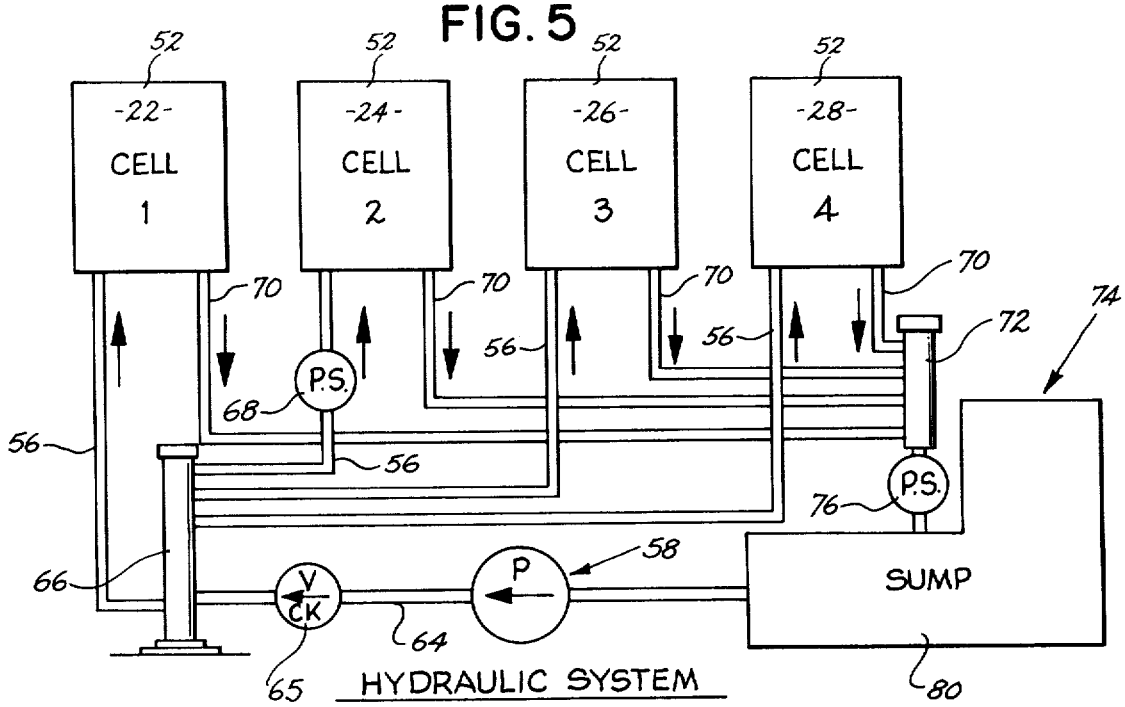
FIG. 5 is a somewhat diagramatic schematic view illustrative of one exemplary fluid supply and exhaust system for maintaining fluid under a desired pressure within the various hollow chamber-defining portions of the effective compressible pad means or cushion means of the reclining chair.

In the exemplary arrangement illustrated, each of the hollow pillows or cushions 22, 24, 26 and 28 is shown as being firmly fastened in place by one particular exemplary type of mounting construction illustrated in representative form in FIG. 4 wherein a pair of integrally attached apertured attachment grommet, tab or ear means 156 are shown, with each being firmly integrally attached to corresponding edge or corner portions of the corresponding hollow pillow 22, in the example illustrated in FIG. 4, although representative of the similar attachment structures for each of the other hollow pillows 24, 26 and 28. Each of the firmly attached apertured grommets, ears or tabs 156 is then fastened by threaded fastener means, such as the representative threaded screws 158 illustrated in FIG. 4, to corresponding portions of the framework means, indicated generally at 30—usually to either inside surfaces or one or the other of the two side wall means 32 or to corresponding portions of the foot member 40 or the underlying mounting panel 48 or any other appropriate rigid members fastened to the framework means 30 at suitable mounting locations. Indeed, in certain forms of the invention such rigid attachment portions may actually be provided at the proper locations on the inside surfaces of the wall means 32 of the framework means 30 for convenient attachment of the edge and corner portions of the four hollow pillows 22, 24, 26 and 28.

Incidentally, it should be noted that while the apertured tab or grommet type of mounting structure shown in the representative form in FIG. 4 is a very advantageous form of construction adapted to provide entirely adequate attachment of the hollow pillows while minimizing any possibility of damage thereto, the invention is not specifically limited to that particular mounting arrangement. Other functionally equivalent mounting arrangements adequate for properly positioning and mounting the multiple pillows in a proper body-receiving relationship may be employed in lieu thereof and all such are intended to be included and comprehended within the broad scope of the present invention. Also, it is quite possible that the positioning of the side wall means 32 and of the corresponding portions of the underlying mounting panel means 48 may be such that each of the hollow pillows may merely be placed in the right position where it will remain at rest by reason of the confinement provided by the adjacent side wall portions 32 and the underlying mounting panel portion 48.

In one preferred form, each of the grommets or apertured ears 156 may be provided with suitable thickened reinforcing portions at regions of localized stress concetrations such as immediately around each of the apertures therethrough, for example, and wherever such stress concentrations might otherwise tend to tear the corresponding attachment grommet or tab.

FIGS. 9, 9A, 10 and 11 merely illustrate, in largely diagrammatic and schematic form, slight variations of the exemplary basic form of the invention illustrated in FIGS. 1–8 inclusive and previously described in substantial detail. Therefore, the modification of FIGS. 9, 9A, 10 and 11 will have similar parts designated by similar reference numerals followed by the letter "a" however. The major difference in the modification just referred to above is the fact that a selection option is provided whereby, in addition to turning on the pump driving motor **60*a* by operating the control switch 62*a*, it is also possible to adjust the inlet pressure-sensing means or switch 68*a* controlling the corresponding switch 70*a* as is perhaps best illustrated in FIG. 9 where said pressure-sensing means 68*a* is shown as comprising a rotary knob 160 capable of rotating an index or pointer portion 162 relative to a numerical scale portion 164 so that the magnitude of the inlet pressure applied to the inner chamber in each of the hollow pillows can be adjusted to any desired magnitude by merely rotating the knob 160, which will have the effect of modifying the spring pressure applied to the switch actuating pressure-sensing means indicated diagrammatically at 68*a* in FIG. 10 so that the normally closed switch 70*a* controlled thereby will open at a corresponding inlet liquid pressure magnitude identical to that selected by the index or pointer 162 of the rotary know and the fixed circular scale 164 of FIG. 9**.

Figure 9A:
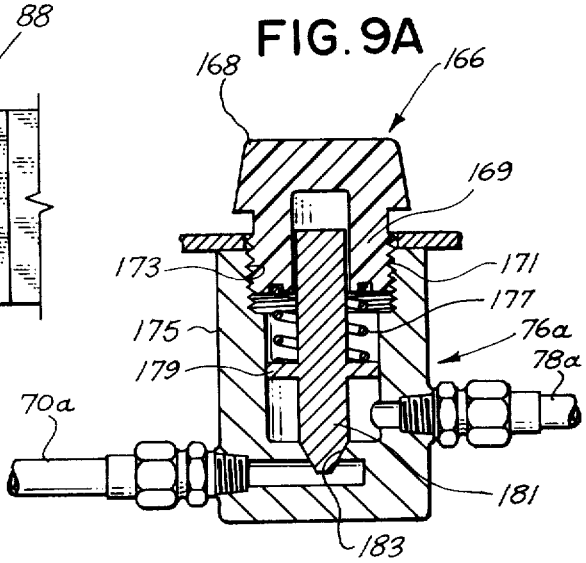
FIG. 9A is an enlarged, fragmentary, sectional view illustrating a sectional view of the outlet liquid pressure bypassing or relief valve means positioned between the inner chambers of the chair cushions (or a pressure equalizing manifold connected thereto) and the reservoir means on the exhaust side of the apparatus for controlling outlet pressure in accordance with manual selective operation of the control unit.
Figure 9:
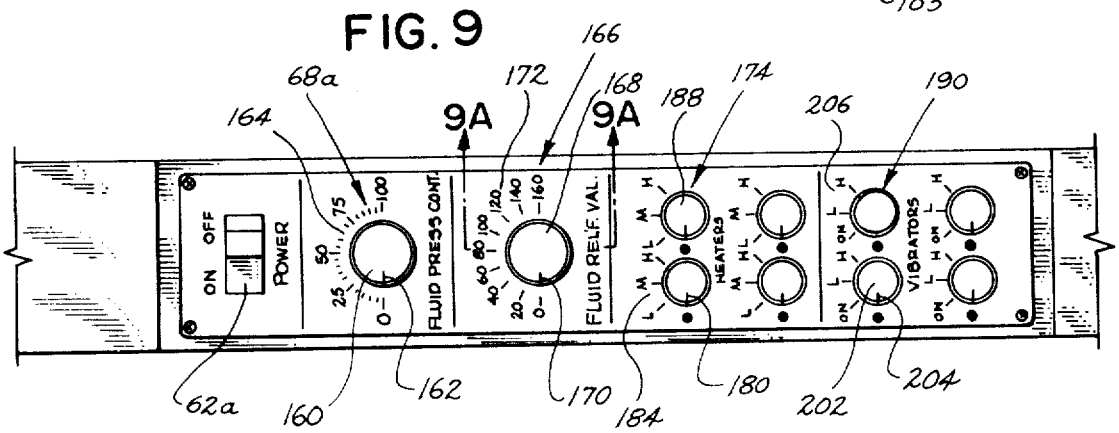
FIG. 9 is another top plan view illustrating a modified type of selector means panel embodying a greater number of different types and magnitudes ranges of manual control selections.

Also, the modified form of the invention has an additional control, as indicated at 166, which controls the previously-mentioned pressure relief or bypass **76*a* which is best shown in FIG. 9 and which corresponds to the pressure relief or bypass valve 76 shown in FIG. 2 of the first form of the invention as being connected between the exhaust manifold 72 and the hollow interior 80 of the reservoir means 74. The connections remain the same in the modifications of FIGS. 9 and 9A, but the adjustable means 166 makes it possible, by adjusting the rotary knob 168 and the index or pointer member 170 thereof relative to the circularly arranged scale 172 thereof, to select the particular pressure magnitude at which the pressure relief or bypass valve 76*a* will effectively open and allow passage from one of the return ducts 70*a* (or from an exhaust or return manifold such as that shown at 72 of FIG. 2 illustrated in the first form of the invention) to pass through the pressure bypass or relief valve 76*a* to the duct 78*a* which in turn is adapted to be connected to the interior of the reservoir means (shown at 74 in FIG. 2 illustrating the first form of the invention). In other words, it is possible, by adjusting the knob 168, to select any particular pressure bypass valve at which the pressure from within any of the hollow pillows will be bypassed back to the reservoir means for the same purposes as previously described in detail in connection with the first form of the invention. The above-described bypass, exhaust or return pressure adjustment feature provided by adjusting the knob 168 is accomplished because of the fact that a lower tubular extension 169 carried by the rotary knob 168 is exteriorly threaded, as indicated at 171, and is threadedly engaged with corresponding interior threads 173 carried within the receiving housing 175 whereby to make it possible to threadedly advance or retract the rotary knob 168 and the exteriorly threaded extention 169 either downwardly or upwardly relative to the housing 175 against the upper end of a biasing spring 177 which has its lower end in biasing abutment with the upper surface of a shoulder 179 carried by the needle valve member 181 whereby to change the differential force required to unseat the needle valve member 181 from the tapered effective valve seat 183 to allow the bypassing, in an exhaust direction, of excessive pressure quantities of the liquid of fluid from within any or all of the inner chambers within any or all of the hollow pillows in a manner similar to that previously described in connection with the first form of the invention at a predetermined or preselected or desired but non-adjustable bypassing pressure. The only difference of the adjustable bypassing valve structure, as shown in detail in FIG. 9A**, is the adjustable feature provided by the structure just described in detail.

Also, the modified form of the invention includes means for selecting the heating level at which the four heating means 82*a* will operate. This is accomplished by the provision of a four corresponding three-position selector switch means, as indicated at 174 in each case in FIGS. 9 and 10, and each of which includes a moveable switch arm 176 capable of being moved to a low-level six selector contact position 178, a medium-level selector contact position 180, or a high-level selector contact position 182 for correspondingly modifying the input current flow to the heater so as to flow through any selected corresponding one of three different thermostatic switch means 84*a*, 84*a*', and 84*a*'' through which the heating current will pass to the heating panel means 82*a* and then back to the other power-supplying lead 90*a*. Each of the four different heater panels 82*a* is similarly provided with three different thermostatic switches 84*a*, 84*a*', and 84*a*'' connected in parallel to each other and independently selectable by operation of the switch arm 176 of each of the temperature selector or heat selector switches indicated generally at 174. Of course, it should be understood that, in this modification, each of the three thremostatic switches 84*a*, 84*a*' and 84*a*'' will be positioned within the hollow inner chamber of the corresponding hollow pillow in a manner similar to the positioning of the single thermostatic switch 84 in the inner chamber 52 of the hollow pillow 22 of the first form of the invention as illustrated in FIG. 7. Thus, it will be understood that whichever one of the three different thermostatic switches 84*a*, 84*a*' or 84*a*'' is the one through which the heating panel current is flowing will, by its temperature-responsive setting, determine the temperature of the liquid or fluid which will be reached as a result of energization of the corresponding heating panel means 82*a* and when that particular one of the three different positionable and independently selectable temperature magnitudes is reached, that particular thermostatic switch, will, of course, become actuated into open condition effectively temporarily de-energizing the heating panel means 82*a* until such time as the temperature of the liquid or fluid falls a predetermined number of degrees, at which point the corresponding thermostatic switch will again be actuated back into closed condition and will cause the re-energization of the corresponding heating panel means 82*a* and thus continue the heating and cooling cycle of the liquid within the corresponding hollow pillow—and all within a selected temperature range, as to upper and lower temperature values, in a manner very similar to the previously fully described mode of operation of the heating means and the single controlling thermostatic switch means 84 of the first form of the invention as shown in detail in FIG. 6 in electrical schematic form.

Figure 10:
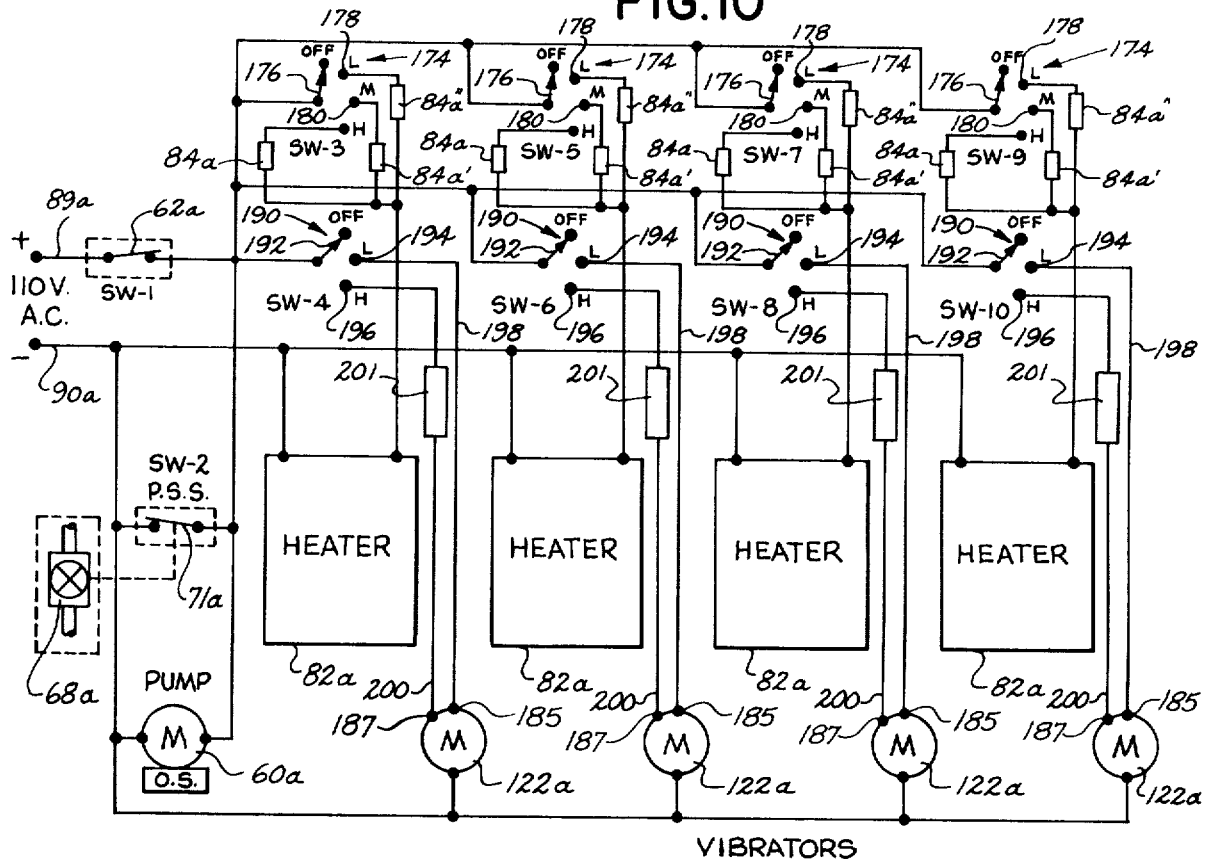
FIG. 10 is a modified electrical schematic somewhat different from the simple electrical schematic of FIG. 6 and comprising the electrical schematic associated with the more complex system illustrated in FIGS. 9 and 9A with respect to the selector controls thereof.
Figure 11:
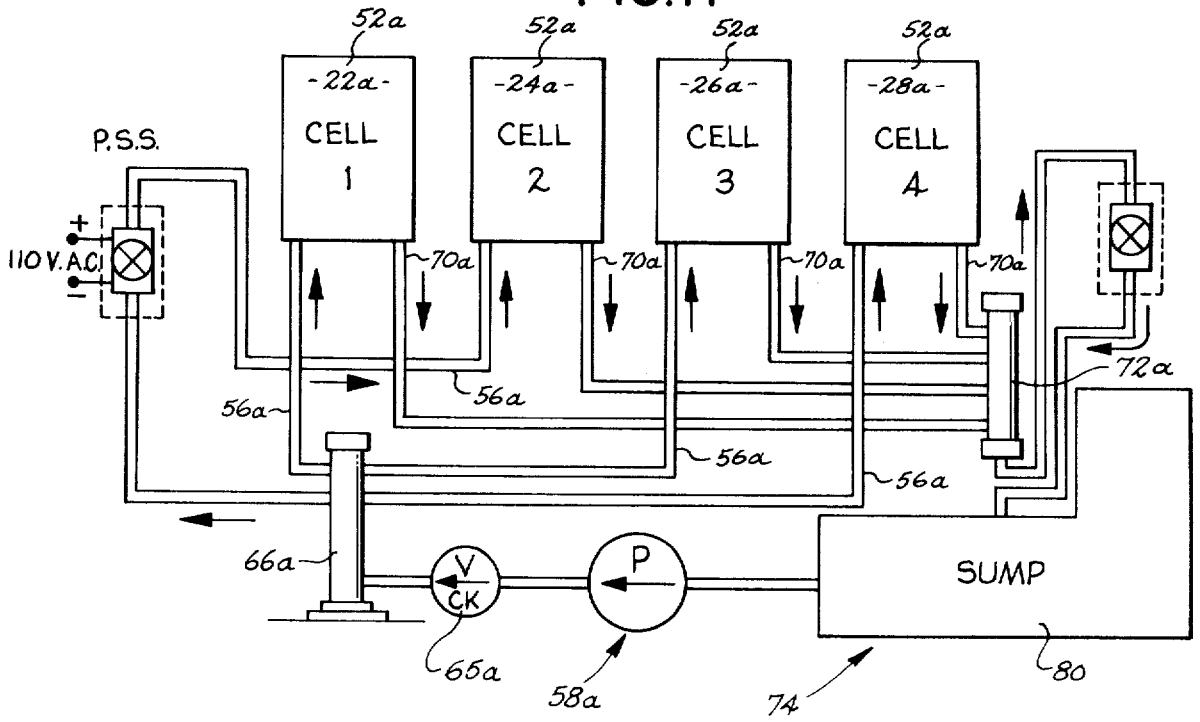
FIG. 11 is a modified fluid system schematic and diagrammatic view similar in many respects to FIG. 5 but illustrating the more complex system illustrated in FIG. 9 and 9A with respect to the controls thereof and illustrated in FIG. 10 with respect to the electrical schematic system corresponding thereto.

Also, in this modification, each of the vibrator motors 122*a* is arranged to be adjustable as to rate of rotation and, consequently, as to the vibratory output thereof which will be effectively applied to the underneath surface of the corresponding hollow pillow in a manner similar to that previously described in connection with the first form of the invention. As illustrated in FIG. 10, the adjustment of the output level of each of the vibrator motors 122*a* is accomplished by an amplitude selector switch means, indicated generally at 190 in each of the four instances, and each having a movable arm 192 capable of moving from an off position as shown in engagement with a low-level contact 194 or a high-level contact 196 which, in the form illustrated, would involve means for effectively selecting either of two different motor terminals 185 or 187 of the corresponding vibrator motor 122*a*. In the example illustrated in FIG. 10, this is accomplished by having the low-level contact 194 connected to the motor lead line 198 which connects to one motor terminal 185, while the high-level contact 196 connects through an alternate motor lead line 200 to the other motor terminal 187. Thus, when the vibrator amplitude selector switch 190 of any of the four different vibrator apparatuses is moved to the low contact position 194, the corresponding vibrator motor 122*a* is energized by way of the contact 185 which connects to interior motor apparatus (usually including at least one winding) arranged to cause the operation of the vibrator motor at a first substantially low-level rate of operation. Alternatively, when the vibrator amplitude selector switch 190 is operated by moving the contact arm 192 into engagement with the high-level contact 196, the corresponding vibrator motor 122*a* is energized by way of the alternate motor lead 200 and the alternate motor terminal 187 which is connected to different interior motor apparatus (usually including at least one different motor winding) arranged to cause a substantially higher level of motor operation than that caused by enrgization of the motor through the first mentioned motor terminal 185.

Each of the four different vibrator amplitude selector switch means 190 is similarly connected to its corresponding one of the four different vibrator motors 122*a* so that it may be differently energized in correspondence with the selective operation of the corresponding amplitude selector switch 190 for either low-level operation or high-level operation.

It should be understood that the selection, through the use of any of the four amplitude selector switches 190, of either of the corresponding terminals 185 or 187 of the corresponding one of the four different vibrator motors 122*a* may be arranged to cause different output (usually different RMP output) in any of several manners well known to the art and, in certain cases, through the use of auxiliary or additional apparatus associated with the motor for that purpose. For example, the two different contacts 185 and 187 may be arranged to energize the motor by way of two different speed-controlling centrifugal switches set to maintain different rates of output rotation, or each of the two terminals 185 and 187 may be effectively connected by way of electrically-energizeable corresponding-different-output-ratio transmission means whereby the output rate of rotation will be correspondingly different depending upon which one of the two transmissions is electrically clutched into engagement with the motor means. These may be composite structures associated right with the motors. Also, selective winding means may be employed for the same purpose.

Alternatively, one or the other of each pair of parallel connected vibrator motor leads 198 and 200, which are capable of independent energization according to the selected position of the switch arm 192 of the vibrator amplitude selector switch means 190, may be provided with frequency modifying means of any well known type such as a frequency doubler or a frequency reducer (such as a frequency halver—the inverse of a frequency doubler) for causing the frequency applied to the corresponding one of the two motor terminals to be greater or lesser than the frequency applied to the other selectable one of the two motor terminals. For example, the frequency applied by such an arrangement to the motor terminal 185 corresponding to low-level operation would be the conventional initially applied frequency, while the frequency applied to the other selectable motor terminal 187 would perhaps be double the normal input frequency as a consequence of having passed through the optional broken line frequency doubling device indicated at 201. This would, of course, cause corresponding high-level output when the selector switch 190 selects the high-level mode of operation by engaging the contact 196 and by feeding the input A.C. through the alternate lead 200 and the frequency doubler 201 to the vibrator motor terminal 187. Of course, this type of arrangement would also be provided for each of the other amplitude selector switches 190 and each of the other vibrator motors **122*a* so that corresponding low or high level opration of each of same could be individually selected by correspondingly operating that particular amplitude selector switch 190** in the desired manner.

In those cases where the input electric power might be initially D.C. or where input A.C. of the type illustrated in FIG. 10 is rectified and/or filtered to comprise D.C. power for energization of the vibrator motors **122*a*, the amplitude selector switches 190 may be arranged to control individual rotary governors set at different speeds and connectible by alternate leads similar to those shown at 190 and 200 to the motor 122*a* which would then be of a series type, and the selection of the corresponding differently set speed governor means would determine the selected rate of vibratory motor output. In such a D.C. system, it is also possible for each amplitude selector switch means 190** to modify the amount of electric current fed to such a D.C. series type vibrator motor which will have the effect of modifying the output speed thereof when under constant load.

Any or all of the arrangements mentioned above may be employed for providing vibrator motor amplitude output selection and, indeed, various other effective functional equivalents thereof may also be employed in lieu of the particular exemplary arrangements illustrated and/or described.

In the example illustrated in FIG. 9, each of the four vibrator motor selector switches 190 is provided with a corresponding rotary knob 202 having an index or pointer member 204 adapted to be rotated relative to a corresponding arcuately arranged scale 206 bearing the off, low and high designations corresponding to the three positions of the switch arm 192 of FIG. 10 described above—that is, the off position, the low-level position, or the high-level position.

The various elements of the pressurization system, the pressurization control and the pressurization selection system, the heating system, the temperature level control and the temperature level selection system, and the various elements of the vibrating apparatus and the control and/or level of output selection system therefor are all exemplary only and may be modified substantially by the provision of various functionally equivalent elements in lieu of the exemplary representative structures shown—and all within the broad scope and teachings of the present invention.

It should be understood that the figures and the specific description thereof set forth in this application are for the purpose of illustrating the present invention and are not to be construed as limiting the present invention to the precise and detailed specific structures shown in the figures and specifically described hereinbefore. Rather, the real invention is intended to include substantially equivalent constructions embodying the basic teachings and inventive concept of the present invention.

What is claimed is:

1. A muscle-relaxing reclining chair comprising:

a body-contoured, body-receiving, compressible cushion means provided with and carried by reclining chair framework means of substantially rigid construction, said body-receiving compressible effective cushion means taking the form of a plurality of compressible, hollow, sealed, inner chamber-defining portions arranged in substantially end-to-end, edge-contiguous relationship to each other; and means of interconnecting each of said hollow inner chamber portions to a source of fluid under pressure;

a fluid supply source having a high-pressure output side connected to said interconnect means for supplying said fluid to said sealed inner chamber portions at a controlled pressure;

a pressure control system including means of pressure sensing, pressure selection, and pressure adjustment in response to said selection, whereby the internal pressure of each said chamber may be set and regulated to a desired level; and means of electrically heating the fluid within each said inner chamber;

a temperature control system including means of sensing the temperature of said fluid, selecting the desired temperatures, and adjustment of said electrical heating means whereby the fluid temperature within each chamber may be set and regulated to a desired level.

2. A muscle-relaxing reclining chair as recited in claim 1, further comprising:

means for individually imparting vibratory movement to each sealed fluid filled inner chamber; and a vibration control system including means of selection of the extent and magnitude of vibration and adjustment of said vibration means whereby the extent and magnitude of vibration of each said chamber may be set and regulated to a desired level.

* * * * *